United States Patent [19]

Bisson

[11] Patent Number: 4,502,404

[45] Date of Patent: Mar. 5, 1985

[54] UPPER THREAD CUTTING UNIT IN BUTTONHOLE SEWING MACHINES

[75] Inventor: Flavio Bisson, Cava Manara PV, Italy

[73] Assignee: Necchi Societa per Azioni, Pavia, Italy

[21] Appl. No.: 539,390

[22] Filed: Oct. 6, 1983

[30] Foreign Application Priority Data

Oct. 28, 1982 [IT] Italy ..... 42917 A/82

[51] Int. Cl.[3] ..... D05B 65/02

[52] U.S. Cl. ..... 112/294

[58] Field of Search ..... 112/294, 293, 291, 65, 112/68

[56] References Cited

U.S. PATENT DOCUMENTS

| | | | |
|---|---|---|---|
| 1,592,115 | 7/1926 | Lindgren | 112/294 X |
| 1,839,823 | 1/1932 | Wood | 112/393 |
| 2,301,798 | 11/1942 | Spaine | 112/293 |
| 3,440,985 | 4/1969 | Kozuka | 112/294 |
| 4,332,209 | 6/1982 | Gauch | 112/294 X |

*Primary Examiner*—H. Hampton Hunter

*Attorney, Agent, or Firm*—Stevens, Davis, Miller & Mosher

[57] ABSTRACT

An upper thread cutting unit in buttonhole sewing machines wherein a lever is provided for connecting and disconnecting the support of the thread cutting unit to and from a supporting member, connected via a lever and rod system, to the stop device of the sewing machine. Two appropriately set springs force the thread cutting unit, at the end of the sewing cycle, under the needle to catch and cut the upper thread and force the unit away from the needle to permit raising higher the work presser frame.

3 Claims, 5 Drawing Figures

UPPER THREAD CUTTING UNIT IN BUTTONHOLE SEWING MACHINES

DISCLOSURE OF THE INVENTION

The present invention relates to upper thread cutting unit in buttonhole sewing machines.

In buttonhole sewing machines known in the art, the upper thread cutting unit is located at the beginning of the cycle in proximity to the needle, under the needle eye, and the work presser frame is raised.

The setting in position of the fabric on which a set of buttonholes are to be formed is difficult, because of the little space between the frame and the bed of the sewing machine. By raising to a greater degree the presser frame, an interference between the presser frame and the thread cutting unit results, causing the unit to be pushed towards the needle. A consequent breakage of the needle will occur. The purpose of the present invention is to overcome the above-described drawback.

The technical problem to be resolved was that of obtaining, at the beginning of the cycle, a greater raising of the presser frame with the removal of the thread cutting unit from the needle. The solution of the technical problem is characterized by the fact that a first rod, connected to the stop device of the sewing machine, acts on a substantially L-shaped lever joined with an element on which a supporting member is pivoted, presenting a pin engaging a slot of a second rod, to which the support of the thread cutting unit is fixed. A first means is provided for connecting the second rod to the support and a second means for taking the thread cutting unit from under and away from the needle.

Other details and features of the invention will stand out from the description given below, by way of non-limitative example and with reference to the accompanying drawings, in which.

Figure 1:
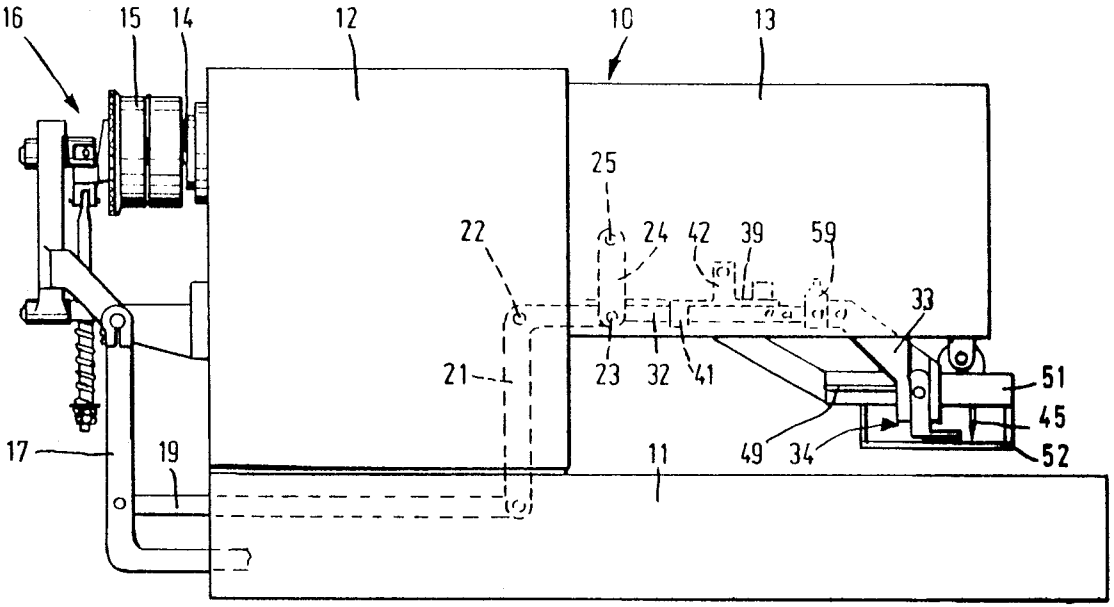
FIG. 1 is a view of the upper thread cutting unit mounted on a buttonhole sewing machine.

Referring to FIG. 1, a buttonhole sewing machine is generally indicated with the reference number 10, comprising a bed 11, a standard 12 and a bracketed arm 13 overhanging the bed 11. An arm shaft 14 extends from the standard 12 and supports a pulley 15, which is engaged by a stop device 16 in order to connect or disconnect the motion transmitted by the electric motor, not shown in the drawings, to the main shaft of the sewing machine. In FIG. 1, the stop device 16 is shown in a position where the sewing operation is stopped. The stop device 16 is driven by a pneumatic cylinder, not shown, which acts on an element 17, on which the end of a first rod 19 is pivoted. The other end of the rod 19 is connected to one end of a substantially L-shaped lever 21, which can rotate about a pin 22. The other end of the lever 21 is connected at 23 to an element 24, pivoted at 26 and freely swingable thereon.

A supporting member 27 is connected to element 24 through a pin 26 (FIGS. 2, 3, 4 and 5). Supporting member 27 presents a pin 29 engaging a slot 31 formed at one end of a second rod 32, at the other end of which a support 33 is fixed. Support 33 has attached thereto the thread cutting unit 34.

On the second rod 32 there is fixed, by screws 37, a little block 35 on which a lever 39 is pivoted. The lever 39 has a first downwardly directed tongue 41 and a second upwardly directed tongue 42, to which a screw 43 is fixed. The function of these tongues will be explained below.

At the beginning of the sewing cycle, the thread cutting unit 34 clamps the upper thread 44 extending from the eye of the needle 45 (FIG. 2) and the lever 39 is held outwardly by the end 46 of the supporting member 27. When the stop device 16 is disconnected and the sewing machine is started, the rod 19 pushes the lever 21 which rotates about the pin 22. A swing of the element 24 towards the standard 12 of the sewing machine consequently occurs. The swing of the element 24 causes the displacement of the support 27 (FIG. 3) until the pin 29 reaches the opposite extremity of the slot 31 (with respect to position illustrated in FIG. 5).

By this displacement, supporting member release lever 39 and the lever 39, biased by a spring 47 fixed at one of its ends to one of the screws 37, rotates about the pin 36 until it forces the tongue 41 against the rod 32 and couples in this way rod 32 to the supporting member 27.

The sewing machine begins the sewing cycle and the thread cutting unit 34, coming in contact with a cam 49 connected to the guide 51 supporting the frame 52, is urged away from the needle towards the outside of the frame and prepares itself to cut the thread at the end of the sewing cycle.

This movement of the thread cutting unit 34 is transmitted, via the linkage support 33 and rod 32, to the supporting member 27 which rotates about the pin 26.

Figure 3:
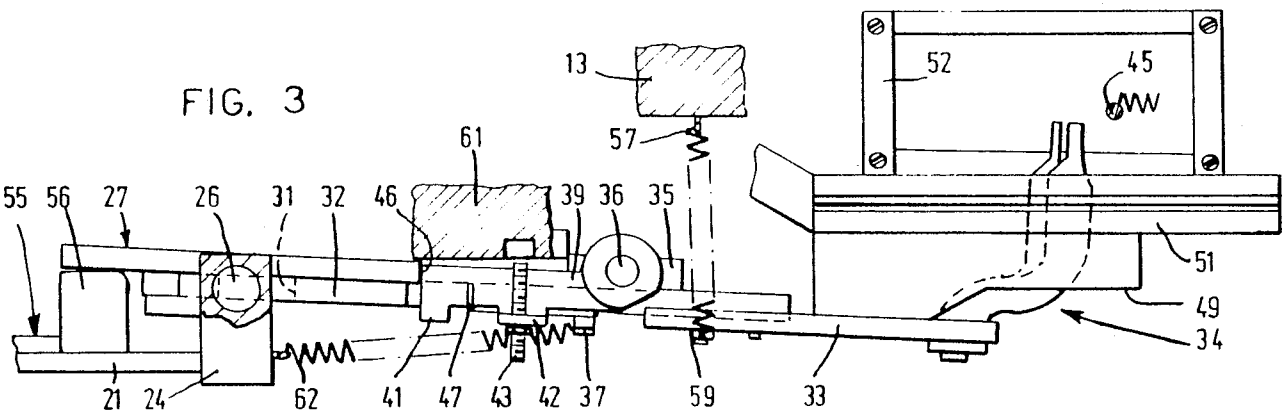
FIG. 3 shows in plan view the position of the thread cutting unit during the sewing cycle and after the stop device disengages.
Figure 4:
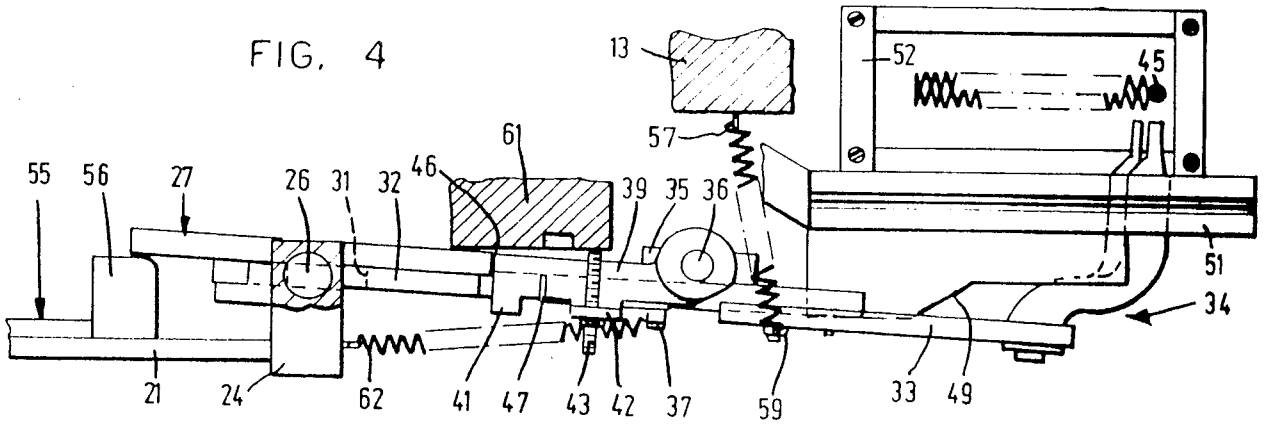
FIG. 4 shows in plan view the position of the third cutting unit at the end of the sewing cycle just after the stop device reengages.

A pneumatic cylinder 53 (FIG. 5) pushes the stem 54 upwardly, setting a rod 55 free which, due to gravity, falls and positions its plate-shaped end 56 between the support 27 and the L-shaped lever 21 (FIG. 3).

At the end of the buttonhole sewing cycle, the stop device is engaged and the sewing machine stops.

The rod 19 pulls the L-shaped lever 21 which, in its rotation on the pin 22, causes the return of element 24 to the sewing cycle start position. The displacement of the element 24 is transmitted to the thread cutting unit 34 via the linkage formed by the supporting member 27, the lever 39, the rod 32 and the support 33. The thread cutting unit in this manner performs in proximity to the needle 45 (FIG. 4) and is prepared to catch the upper thread and to cut it.

Figure 5:
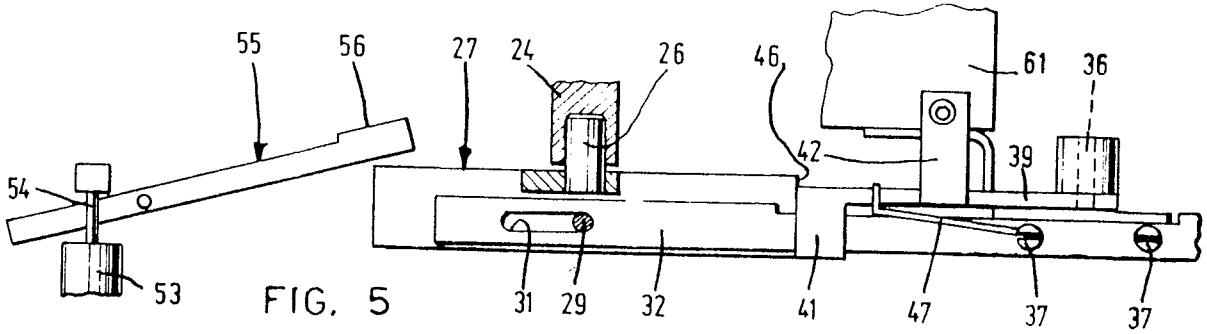
FIG. 5 shows a particular of FIG. 2.

The pneumatic cylinder is activated to lower stem 54 to the position illustrated in FIG. 5. Consequently, the end 56 of the rod 55 is removed from its position between the support 27 and the lever 21. A spring 57, connected at one of its ends to the arm 13 and at the other end to a pivoted rod 59 (FIGS. 1, 2, 3 and 4) fixed to the support 33, biases support 33 and thus the thread cutting unit 34 towards the needle 45, causing the support 27 to rotate around the axis of the pin 26 via the abovedescribed linkage. This rotation forces the end of the screw 43 against a plate 61, causing the lever 39 to rotate on the pin 36. This movement disconnects the lever 39 from the end 46 of the support 27, overcoming the resistance of the spring 47. In this way, rod 32 is disengaged from the supporting member 27.

Figure 2:
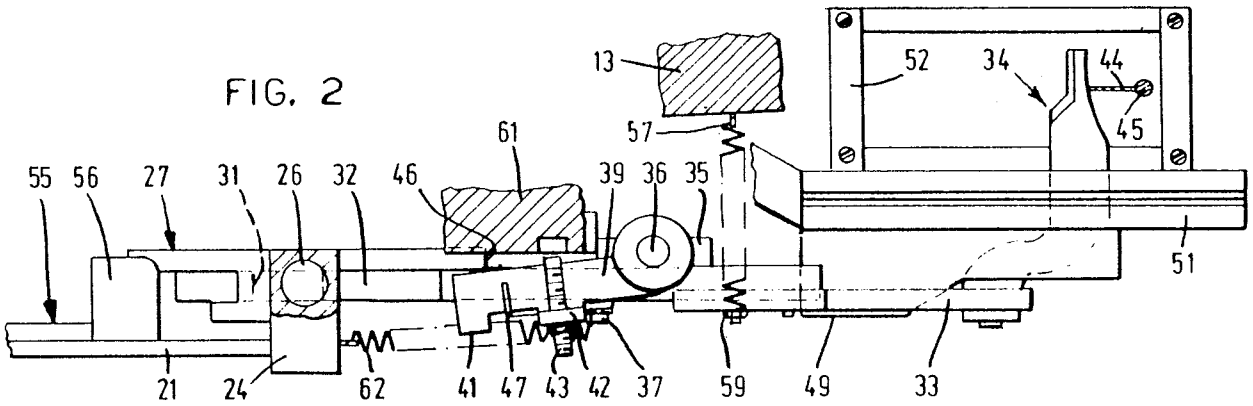
FIG. 2 shows in plan view the position of the thread cutting unit at the beginning of the sewing cycle before the stop device disengages.

A spring 62, fixed at one end to the element 24 and at the other end to the screw 37, to which is also fixed the spring 47, pulls, at this point, the rod 32 and forces it into the condition illustrated in FIGS. 2 and 5, causing the slot 31 to run over the pin 29. The appropriate strengths of the springs 57 and 62 permits the cutting of the upper thread by taking the thread cutting unit 34 under the needle 45 and removing this unit 34 from the needle. In this way, frame 52 is permitted to be raised higher without the danger of the thread cutting unit hitting against the needle and consequently breaking it.

I claim:

1. An upper thread cutting unit in a buttonhole sewing machine having a needle, comprising a first rod, connectable to a stop device of the sewing machine, a substantially L-shaped lever joined to said first rod, an element pivotally mounted and pivotally connected to said L-shaped lever, a support member pivotally mounted on said element and defining a pin extending therefrom, a second rod defining a slot therein into which said pin slides, a support for thread cutting means fixed to said second rod, a first means for connecting said second rod to said support member and second means for taking said thread cutting means under and away from said needle.

2. The thread cutting unit according to claim 1, including a spring and a screw, wherein said first means for coupling said second rod to said support member comprises a lever having two tongues, one tongue limiting the oscillations of said lever against said second rod due to the action of said spring and the other tongue mounting said screw to permit said second rod to be coupled to and uncoupled from said supporting member.

3. The thread cutting unit according to claim 1, wherein said second means for taking said thread cutting means under and away from the needle, comprising springs appropriately set for forcing the catching and cutting of the thread and removing said thread cutting means from the needle, said springs being fixed to an arm of the machine and the other of said springs being fixed to said second rod and said element on which said supporting member is pivoted.

* * * * *